US010086641B1

(12) United States Patent
Vazquez

(10) Patent No.: US 10,086,641 B1
(45) Date of Patent: Oct. 2, 2018

(54) THERAPEUTIC COGNITIVE FOCUS DEVICE

(71) Applicant: Wilfredo Vazquez, Milford, MA (US)

(72) Inventor: Wilfredo Vazquez, Milford, MA (US)

( * ) Notice: Subject to any disclaimer, the term of this patent is extended or adjusted under 35 U.S.C. 154(b) by 0 days.

(21) Appl. No.: 15/598,415

(22) Filed: May 18, 2017

Related U.S. Application Data

(63) Continuation of application No. 15/590,241, filed on May 9, 2017.

(51) Int. Cl.

| | |
|---|---|
| ***B43K 29/00*** | (2006.01) |
| ***A63F 9/00*** | (2006.01) |
| ***B43K 29/02*** | (2006.01) |
| ***A63H 1/00*** | (2006.01) |

(52) U.S. Cl.
CPC ..... *B43K 29/02* (2013.01); *A63F 9/001* (2013.01); *A63H 1/00* (2013.01); *A63F 2009/0055* (2013.01)

(58) Field of Classification Search
CPC .. B43K 29/00; A63F 9/001; A63F 2009/0018; A63F 2009/0055
USPC ..... 401/195; 446/73
See application file for complete search history.

(56) References Cited

U.S. PATENT DOCUMENTS 141,287 A * 7/1873 Orndorff ..... B43K 23/004 15/443
1,291,972 A * 1/1919 McGuigan ..... A45D 40/0081 24/10 R
2,488,179 A * 11/1949 Engel, Jr. ..... B43K 21/006 401/214
3,063,419 A * 11/1962 Parker ..... B43K 24/02 335/285
3,639,069 A * 2/1972 Gordon ..... B43K 29/20 401/195
4,526,547 A * 7/1985 Rusk ..... G09B 11/00 401/6
4,983,062 A * 1/1991 Hour ..... A63F 9/001 273/153 S
5,186,562 A * 2/1993 Yoshinaga ..... B43K 24/082 401/112
5,281,039 A * 1/1994 Hsiung ..... A63F 7/042 273/113
5,328,172 A * 7/1994 Jagiella ..... A63F 7/048 273/144 B
5,505,553 A * 4/1996 Saviano ..... B43K 23/004 401/100

(Continued)

*Primary Examiner* — Alexander Niconovich
(74) *Attorney, Agent, or Firm* — Chapin IP Law, LLC

(57) ABSTRACT

A cognitive focus device includes a focusing element rotationally engaging a utilitarian elongated body having a predetermined purpose or usage apart from the rotating focusing element. The focusing element has a threaded bore for engaging a corresponding helical groove on the elongated body, and may include other attachments responsive to manual dexterity. The elongated body has an unobtrusive, alternative primary purpose such as a writing implement so as to appear unobtrusive and coincidental in ordinary usage contexts. The focusing element maintains a shape and color consistent with the usage context such that it is consistent with normal decorum. The elongated has a continuous, integrated structure resulting from fabrication of the helical groove onto an object having a preexisting utilitarian function, such as a pen or pencil. The resulting cognitive focus device is readily manufacturable and conforms to an environment based on the structure of the focusing element.

9 Claims, 8 Drawing Sheets

(56) References Cited

U.S. PATENT DOCUMENTS 6,120,023 A * 9/2000 Lai ..... A63F 7/048 273/144 B
6,158,914 A * 12/2000 Junkins ..... B43K 5/005 401/195
6,244,772 B1 * 6/2001 Ruchonnet ..... A44C 17/0291 401/195
6,296,409 B1 * 10/2001 Cherry ..... B43K 23/004 16/430
6,612,766 B2 * 9/2003 Collins ..... B43K 7/005 401/195
6,752,556 B2 * 6/2004 Pearce ..... A46B 5/026 16/430
6,966,717 B1 * 11/2005 Kuo ..... B43K 5/005 401/195
7,014,379 B2 * 3/2006 Cheng ..... B43K 23/004 16/430
7,275,744 B1 * 10/2007 Kuo ..... A63F 9/001 273/153 S
7,780,499 B1 * 8/2010 Truckai ..... A63H 33/088 401/195
8,523,468 B2 * 9/2013 Sheena ..... A45D 40/04 401/19
9,744,796 B1 * 8/2017 Lyon ..... B43K 24/00
2006/0280545 A1 * 12/2006 Zawitz ..... B43K 5/005 401/6
2007/0048067 A1 * 3/2007 Gerules ..... B43K 23/001 401/195
2007/0059089 A1 * 3/2007 Junkins ..... B43K 5/005 401/195
2008/0175650 A1 * 7/2008 Geddes ..... B43K 23/001 401/195
2011/0027002 A1 * 2/2011 Castro ..... B43K 23/12 401/195
2012/0308291 A1 * 12/2012 Weiner ..... B43K 29/00 401/195
2013/0272772 A1 * 10/2013 Lee ..... G09F 19/06 401/195
2014/0112696 A1 * 4/2014 Osborne ..... B43K 29/00 401/195
2015/0090059 A1 * 4/2015 Lee ..... F16H 25/122 74/89
2017/0136805 A1 * 5/2017 Hoffman ..... B43K 29/00

* cited by examiner

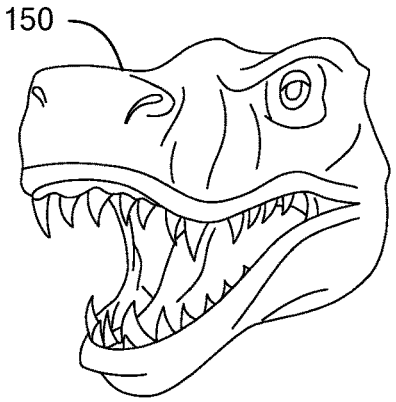
FIG. 8A1
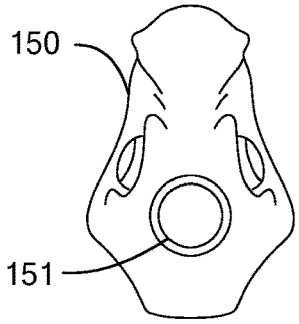
FIG. 8A2
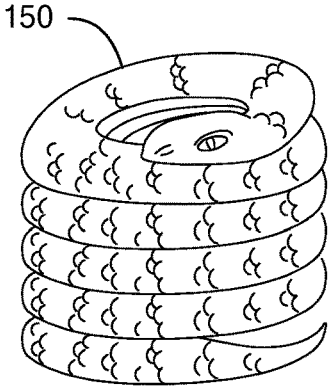
FIG. 8B1
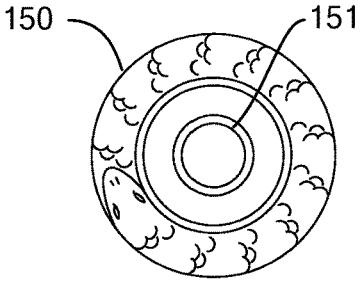
FIG. 8B2
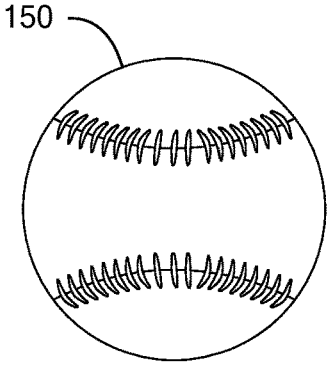
FIG. 8C1
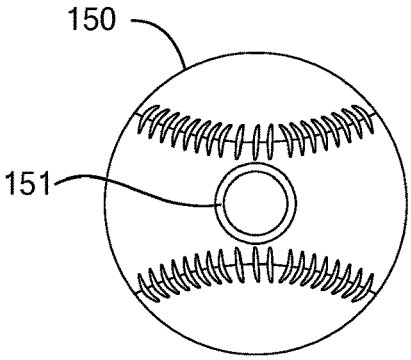
FIG. 8C2

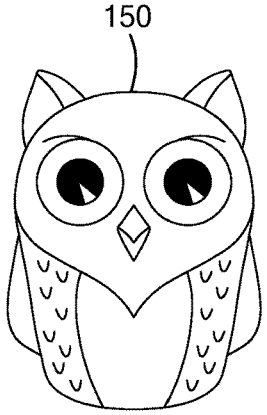
FIG. 8D1
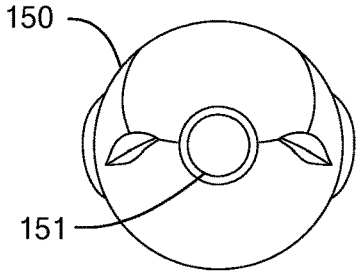
FIG. 8D2
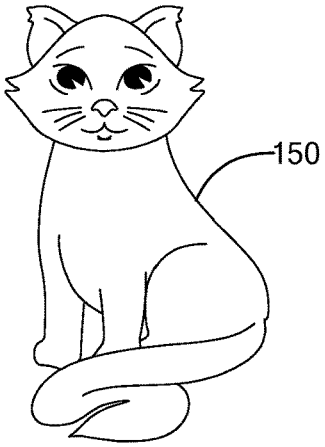
FIG. 8E1
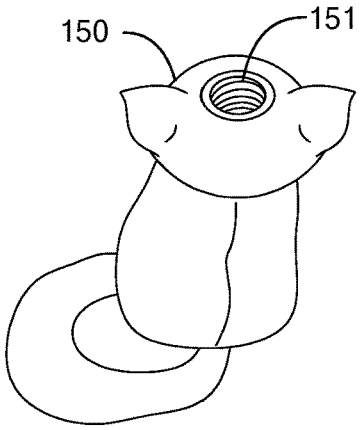
FIG. 8E2
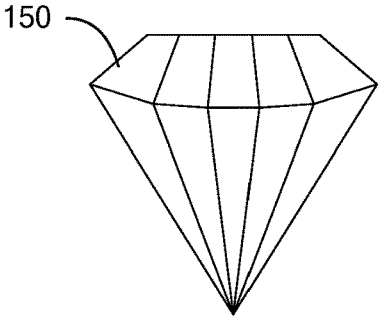
FIG. 8F1
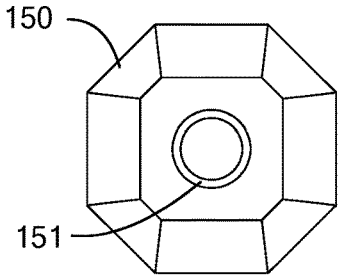
FIG. 8F2

THERAPEUTIC COGNITIVE FOCUS DEVICE

RELATED APPLICATIONS

This application is a continuation under 35 U.S.C. § 120 of U.S. patent application Ser. No. 15/590,241, filed May 9, 2017, entitled "THERAPEUTIC COGNITIVE FOCUS DEVICE," incorporated herein by reference in entirety.

BACKGROUND

Cognitive focus conditions such as ADD (Attention Deficit Disorder) and ADHD (Attention-Deficit/Hyperactivity Disorder) have been brought to a forefront of treatable conditions in recent decades. Conventional approaches, tending to dismiss a perceived lack of attention span, have evolved to recognize minor mental tasks that have a way of diverting mental energies to permit greater focus and meaningful application of mental effort. Particularly in juvenile contexts, where school performance tends to bring such conditions to light, devices that help redirect cognitive effort in a productive fashion are being recognized for the science supporting their usage.

SUMMARY

A cognitive focus device includes a focusing element rotationally engaging a utilitarian elongated body having a predetermined purpose or usage apart from the rotating focusing element. The focusing element has a threaded bore for engaging a corresponding helical groove on the elongated body, and may include other fixtures such as a joystick, slider, roller, pushbutton or other attachment responsive to manual dexterity. The elongated body has an unobtrusive, alternative primary purpose such as a writing implement so as to appear unobtrusive and coincidental in ordinary usage contexts. The focusing element maintains a shape and color consistent with the usage context such that it is consistent with normal decorum. The elongated body has a continuous, integrated structure resulting from fabrication of the helical groove onto an object having a preexisting utilitarian function, such as a pen or pencil. The resulting cognitive focus device is readily manufacturable and conforms to an environment or context based on the structure of the focusing element.

Configurations herein are based, in part, on the observation that attention and mental focus have been associated with fine motor or dexterity capabilities and usages. Object manipulation requiring active usage of hands and digits can assist in focusing or redirecting mental energy or capacity, as motor usage involving repetitive physical tasks can have a way of absorbing excess physical energies that may be diverting an attention focus. Emerging research suggests the benefits of fine motor exercises for developmental enhancement. Such fine and/or repetitive motor skill usage also has benefits for rehabilitation or developmental needs.

Various studies and medical research, therefore, has shown the benefits of activities that require small, repetitive digit usage for improving mental focus, rehabilitation and other therapeutic usages. Treatment of Attention-Deficit/Hyperactivity Disorder (ADHD) in children and adults has shown a need for unobtrusive and portable mediums for diverting excessive energy and motor inclinations.

Unfortunately, conventional approaches to portable, fine motor exercise devices suffer from the shortcoming that unobtrusiveness, portability, and manufacturability are problematic. Devices such as a small, colorful cube having different manipulation capabilities on each side have been proposed as a mechanism for absorbing excess "fidgeting" energy. However, conventional devices have the appearance of a child's toy, and may not be appropriate for adult usage, particularly in professional settings. Further, such devices have small moving parts, which complicate the design and can increase manufacturing costs, as well as presenting a detachment hazard if moving pieces break off.

Accordingly, configurations herein substantially overcome the shortcomings of conventional motor stimulation approaches by providing an integrated rotational focusing element adapted for attachment to a preexisting appliance such as a pen or pencil. The focusing element has a threaded bore for engaging a helical groove on an elongated body such as the pen or pencil, and can be fabricated for the decorum of a desired context. For example, a jewelry grade metal may be installed around a fashionable pen for a device that suits a professional environment. A pencil fabrication maintains a low cost and can be paired with an on-trend insignia on a focusing element, such as depictions of musical or acting personalities to suit adolescents and young adults. And of course, broad threads along with bright colors may be directed towards toddlers or elementary age users.

There has been much research in recent decades about the effect of stress and related mental influences on physiological health. This so-called "mind body connection" has led to an awareness of mental wellness, including alleviation of stress and anxiety. Alleviation of stress can be a major wellness aspect for those prone to such ailments. So called "self regulation" tools strive to occupy and/or divert excess energy, such as by keeping fingers occupied, helping to calm nerves, promote focus and concentration, and increase tactile awareness of the fingers.

In particular, the cognitive focus device allows the user to relieve tension through rotation of the focusing element, and provides nerve stimulation by digits (fingers) physically manipulating the focusing element. Substantial research has demonstrated a correlation between hand manipulations, sometimes called "fidgeting," and memory, attention span, and focus, and has also has therapeutic outlets in treatment of ADD and ADHD.

In further detail, configurations herein provide a therapeutic cognitive focus device, including an elongated body adapted for handheld operation, and a helical pattern in an exterior of at least a portion of the elongated body to define a helical portion. A focusing element is adapted for rotational communication with the elongated body, such that the focusing element is adapted to be disposed along a length of the elongated body resulting from the rotation, and the elongated body defines a primary purpose unaffected by the focusing element, such for usage as a writing implement.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

FIGS. 8A1-8F2 show alternate configurations of the focusing element of FIG. 4;

DETAILED DESCRIPTION

Configurations below depict an example implementation of the cognitive focus device including a focusing element engaging an unobtrusive article such as a pen or pencil that conforms to the environment in which it is used to avoid drawing attention to the patient/user as invoking a specialty device and/or alluding to a particular condition addressed by the device.

ADHD is a disorder marked by both an inability to sustain attention, and an increased amount of hyperactivity and impulsivity. Activities dubbed as "fidgeting" have been shown to increase concentration in elementary aged children with ADHD by providing a mechanism for cognitive self-regulation. As a result, so-called "fidget toys" have garnered success by being an unintensive way to harness nervous energy or hyperactivity in order to boost attention and focus. A spinning element has been shown to relieve other fidgeting and allow the user to focus better. From a clinical perspective, the spinning object is intended to stimulate the part of the mind that gets bored, thus, allowing other parts of the brain to focus. However, conventional spinning elements tend to be bulky, colorful, and do not appear to fulfill any other role other than an apparent amusement.

The focusing element fulfills a role in relief of minor stress, nerve or muscle stimulation, and to improve concentration in both business and academic settings, and in a discreet or unobtrusive manner. For example, it is commonplace to observe an attendee, colleague or student engaging in seemingly irrelevant or ungermane writings, a practice colloquially referred to as "doodling." However, doodling and other indicators suggesting disinterest, boredom or inattentiveness may be viewed negatively from a supervisory or oversight perspective, or simply as rudeness to the speaker. The focusing element, in contrast, discreetly occupies a place in conjunction with a primary purpose, such as attached to a writing implement such as a pen or pencil.

Conventional approaches to devices and practices directed towards inattentiveness or focus of excess energy include objects or devices which may have a toy-like, amusing, or unprofessional appearance, or otherwise detract from the decorum of the setting. Beneficiaries of the disclosed device may be reluctant to carry a puzzle or cube having a colorful or juvenile appearance. However, the focusing device can take a more formal appearance to align with the usage setting, such as taking a polished metal appearance so as to appear as a jewelry or fashion accessory.

Other conventional approaches attempt to modify a pen with a circumferential novelty device, such as that shown in U.S. Pat. No. 6,262,409. This approach suggests promotional insignia on a rubber tube around a pencil, however it is frictionally engaged and no advancement along a length based on rotational or threaded communication is shown.

Figure 1:
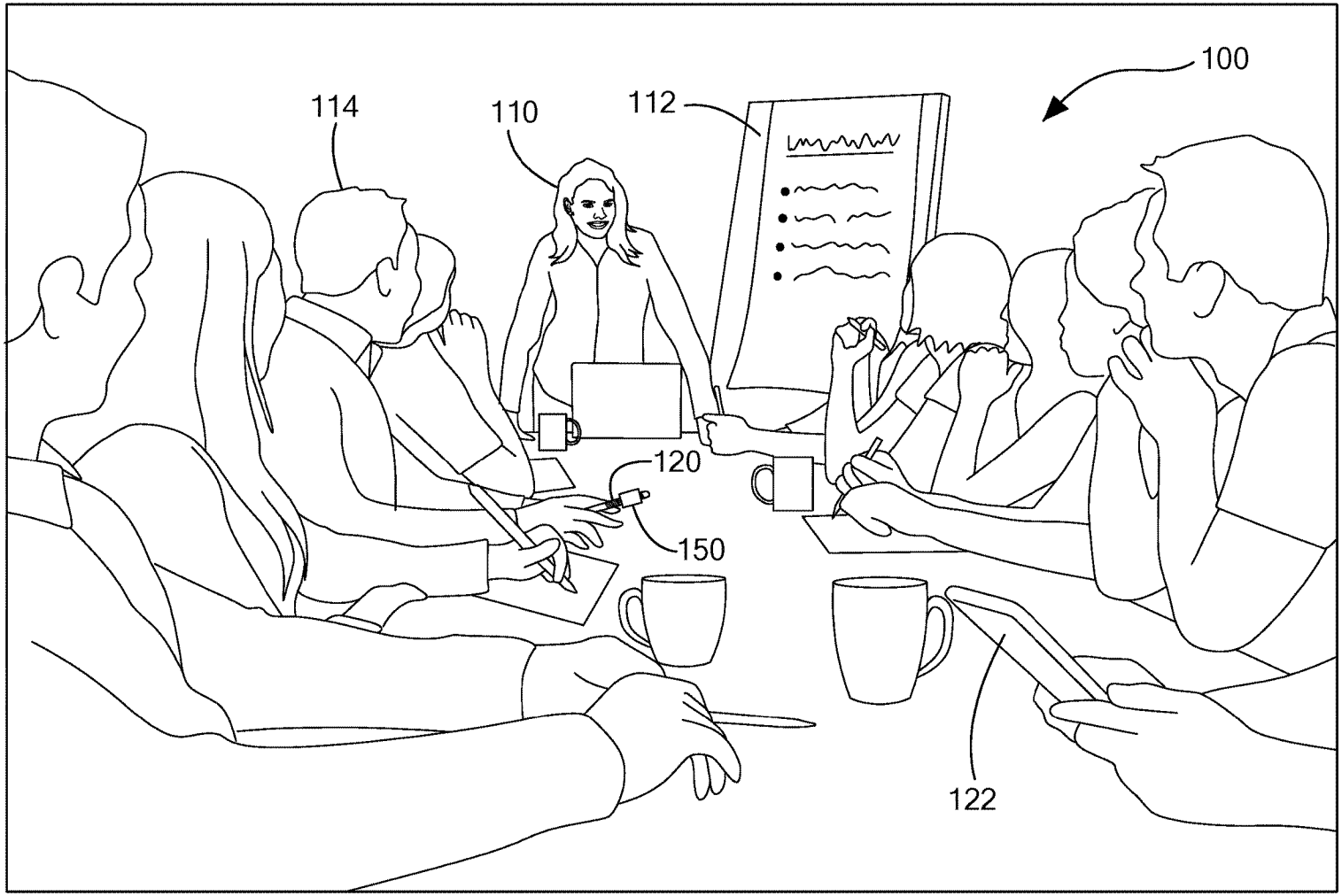
FIG. 1 is a context diagram of a usage environment corresponding to the disclosed approach.

FIG. 1 is a context diagram of a usage environment corresponding to the claimed invention. Referring to FIG. 1, in an interaction environment 100 of multiple people and information sources, such as a classroom, boardroom or lecture hall, there are many stimuli. Such stimuli include, most notably a meeting or lecture facilitator 110, but also a whiteboard or display screen 112, other participants, who occasionally engage in side conversations, windows, and one's own notes and/or slide packet. Participants 114 often utilize a writing implement 120, such as a pen, pencil or stylus, in conjunction with a pad or device 122.

In such a setting, wielding or using a prop specifically intended as a focusing or attentiveness device may appear awkward or as a sign of boredom. Since the writing implement 120, however, is an expected accessory, to which a focusing element 150 can be attached, it avoids drawing excess attention and conforms, as disclosed further below.

Figure 2:
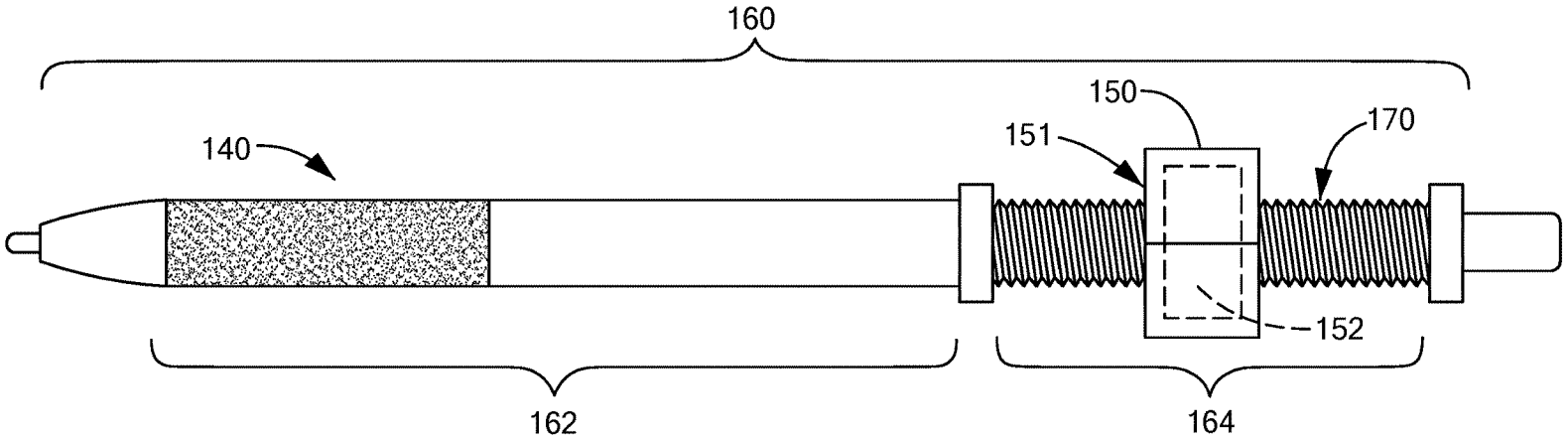
FIG. 2 is a side elevation of the cognitive focus device.

FIG. 2 is a side elevation of the cognitive focus device. Referring to FIG. 2, the cognitive focus device 140 includes an elongated body 160 having an unmodified or unpatterned portion 162, and a helical portion 164. The unpatterned portion remains unmodified or unchanged from a primary purpose, and the helical portion 164 has a groove 170 in a helical pattern around the outer surface of the elongated body 160. The focusing element 150 rotates around the helical portion 164 on a threaded bore 151 adapted to receive the helical groove 170. An attachment region 152 can be used for additional props or insignia, discussed further below.

In operation, the therapeutic cognitive focus device 140, includes an elongated body 160 adapted for handheld operation, and a helical 164, spiral or threaded pattern in an exterior of at least a portion of the elongated body 160. The focusing element 150 is adapted for rotational communication with the elongated body 160 along the helical portion 164, and is adapted to be disposed along the length of the elongated body resulting from the rotation by engagement with the helical groove 170, forming a threaded or thread-like engagement. Since the focusing element 150 is threadedly engaged with the helical portion 164, it is suited for rotational advancement along a length of the elongated body 160.

The elongated body 160 is defined for a primary purpose unaffected by the focusing element, such as writing or marking, or other usage suited to the elongated shape. The threaded portion 164 may extend any suitable length until the unpatterned portion 162. The threaded portion 164 should not interfere with the primary purpose, such as handwriting, but should allow sufficient rotational travel of the focusing element 150.

Figure 3:
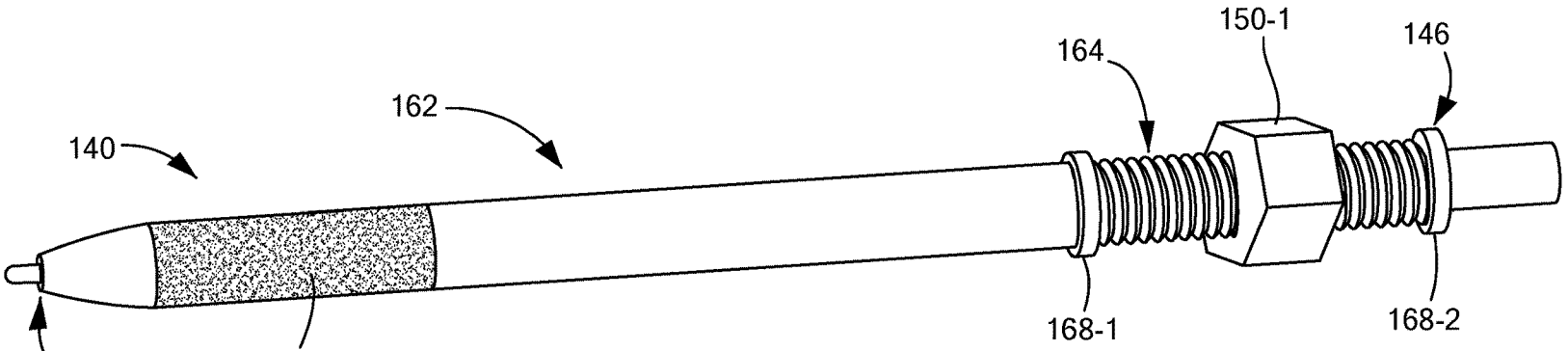
FIG. 3 is a perspective view of the cognitive focus device of FIG. 2.

FIG. 3 is a perspective view of the cognitive focus device of FIG. 1. Referring to FIGS. 2 and 3, the elongated body 160 has a utilitarian function normally resulting from or controlled by handheld operation. This allows the cognitive focus device 140 to conform to a non-therapeutic usage environment and avoid undue attention by its presence. For example, in the disclosed configuration, the elongated body 160 is operable as a pen, such that the elongated body 160 defines an internal cavity for storing ink and has a distal end 144 attached to a friction driven ink delivery mechanism, such as in a ball point pen. In this configuration, the threaded portion 164 extends from a proximal end 146 of the elongated body 160. An alternate surface 142 at the distal end 144 may balance the helical portion 164 at the proximal end 146 to create a symmetrical appearance.

The elongated body 160 may further include one or more stop ring 168-1 . . . 168-2 (168 generally). The stop rings 168 are concentrically disposed around the elongated body 160 and may defining a transition between the helical portion 164 and the unpatterned portion 162, in which the stop ring is adapted for interference with rotation of the focusing element 150-1 (150-1 . . . 150-N, 150 generally). The proximal end 146 may have a stop ring 168-2 to prevent travel off the proximal end.

Figure 4:
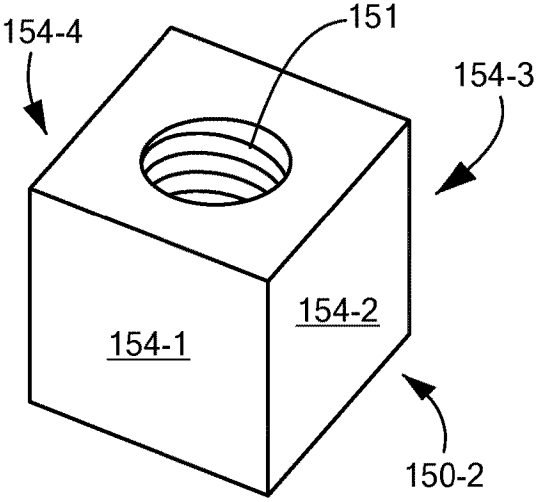
FIG. 4 is a perspective view of a particular configuration of the focusing element of FIGS. 2 and 3.

FIG. 4 is a perspective view of a particular configuration of the focusing element 150-2 of FIGS. 2 and 3. The particular configuration of the focusing element 150-2 includes 4 faces 154-1 . . . 154-4 (154 generally). Each of these faces 154 can provide the attachment region 152 for enhanced manipulators, discussed further below. The focusing element 150-2 has a threaded bore 151 for engaging the groove 170, such that the threads correspond to the helical pattern for disposing the elongated body 160 through the bore 151. A tolerance between the helical pattern and the threads in the bore 151 facilitates rotation over a tighter fit as would be required in load-bearing connections. For example, the helical pattern may have square or trapezoidal edges, and need not be immediately adjacent as in a load bearing thread, but could rather be separated at intervals on each circumferential pass defined by the helical pattern. In the example of FIG. 4, the focusing element 150 is substantially cubical and the threaded bore 151 is centered on opposed sides of the cubical shape.

Figure 5:
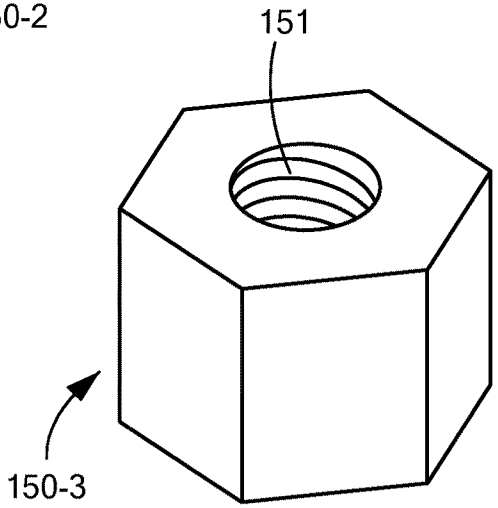
FIG. 5 is a perspective view of a focusing element having an octagonal shape.

FIG. 5 is a perspective view of an alternate configuration of a focusing element 150-3 having an octagonal shape. Any suitable shape may define the focusing element 150, and considerations such as the dexterity of the patient/user and the ability to manipulate may be taken into account when fabricating the focusing element 150.

Figure 6:
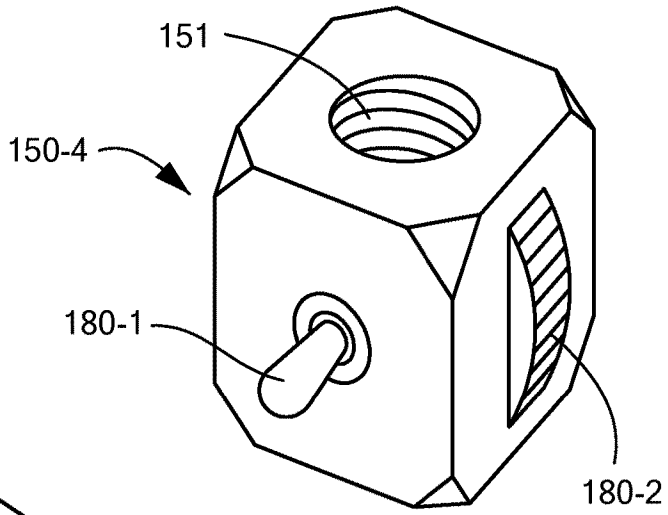
FIG. 6 is a perspective view of a focusing element as in FIG. 4 with additional fixtures.

FIG. 6 is a perspective view of a focusing element as in FIG. 4 with additional fixtures and chamfered corners. Referring to FIGS. 2, 4 and 6, the attachment region 152 serves for additional features, mechanisms and/or manipulators, and may be based the intended patient/user of the device. In FIG. 6, moveable fixtures 180-1 and 180-2 (180 generally) are disposed on the focusing element 150-4 and adapted for movement independent of the rotation of the focusing element 150. The moveable fixtures 180 define additional manipulators based on a therapeutic motor exercise intended for satisfying a user regime. The fixtures 180 include a joystick 180-1 and roller 180-2. Any suitable manipulator and attachment to the focusing element 150 may be employed. The fixtures 180 may take the form of a joystick, slider, roller, pushbutton or other manipulators 180 attached to the face 154 and adapted for independent movement.

Figure 7A:
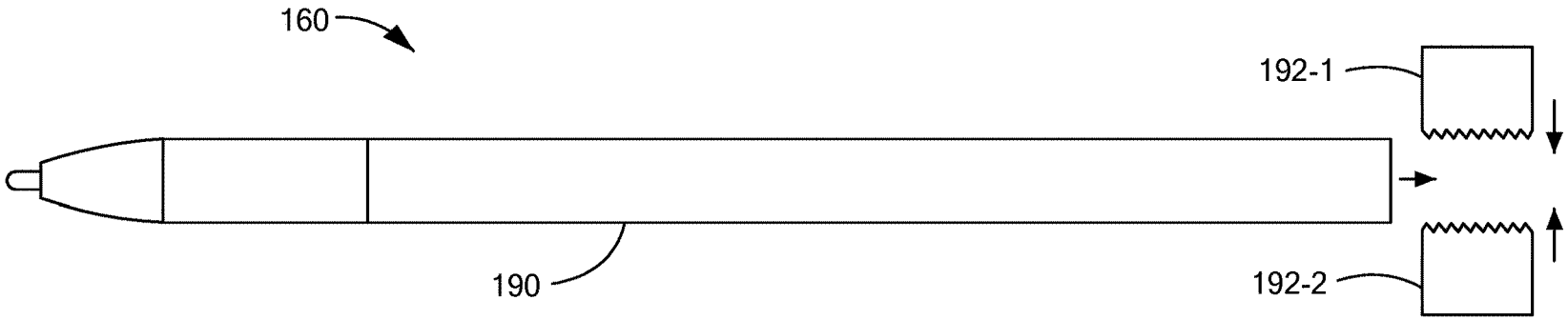
FIGS. 7A and 7B show formation of the helical groove in the elongated body.
Figure 7B:
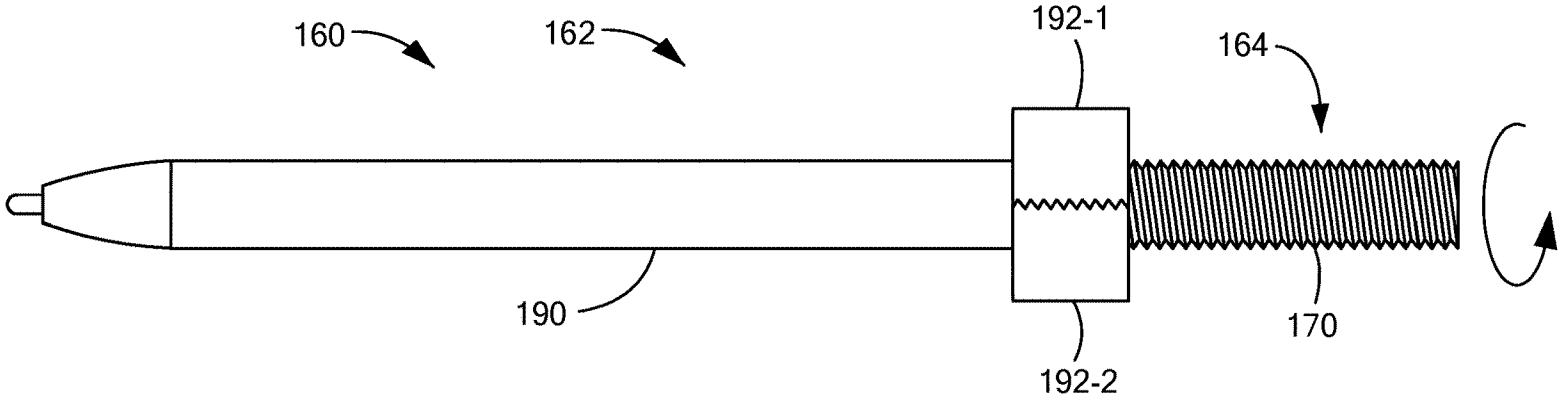

FIGS. 7A and 7B show formation of the helical groove 170 in the elongated body 160. As the elongated body 160 may define a pen, pencil or other writing implement having a primary purpose of written communication, the disclosed approach applies the helical groove 170 to the continuous body of a preexisting article. The unpatterned portion 162 and helical portion 164 result from the same homogeneous article as the helical portion 164 is subsequently formed. Referring to FIGS. 3 and 7A-B, the elongated body 160 defines a writing implement, such that the helical groove 170 is formed on a preexisting surface of the writing implement 190 or other preexisting article.

In FIGS. 7A and 7B, the method of forming a cognitive focusing device includes disposing a forming tool 192-1 . . . 192-2 (192 generally) in communication with the elongated body 160 defined by an exterior of the elongated object. The forming tool 192 may be a cutting die, a serrated blade, or other tooled surface for forming the helical pattern. Rotation of the elongated body 160 forms helical pattern on the elongated body, such that the formed helical pattern extends over at least a portion of the elongated body 160 to define the helical portion 164. The focusing element 150 may then be disposed for rotational communication with the helical portion of the elongated body.

Two or more forming tools 192 may be brought together in a compressive manner around the elongated body 160, and the elongated body rotated for cutting the helical groove 170. The forming tool 192 includes at least one section configured for abrasive engagement for selective removal of the exterior, which is forcefully disposed against the exterior, and rotation applied to the elongated body 160 for material removal to define the helical pattern. A single tooth or protrusion could also be employed for the helical portion as the elongated body 160 is both rotated and transversely disposed across the forming tool 192 to cut the groove 170.

Alternatively, the forming tool 192 may be adapted for additive operations on the exterior, by depositing a formable material on the exterior to form the helical pattern. A deposition process, 3D printing, or molding approach could add the helical pattern, rather than cutting and removing material. In either approach, the elongated body 160 defining the writing implement 190 is therefore continuous between the helical portion 164 and the unpatterned portion 162, having been formed from the same continuous body, substrate or article.

FIGS. 8A1-8F2 show alternate configurations of the focusing element of FIG. 4. Referring to FIGS. 8A1-8F2, front and plan views of various configurations of focusing elements 150 and corresponding bore 151. Any suitable shape or size adapted for engaging the helical portion 164, and may be modified for various dexterity levels for a convenient grip.

Figure 9A:
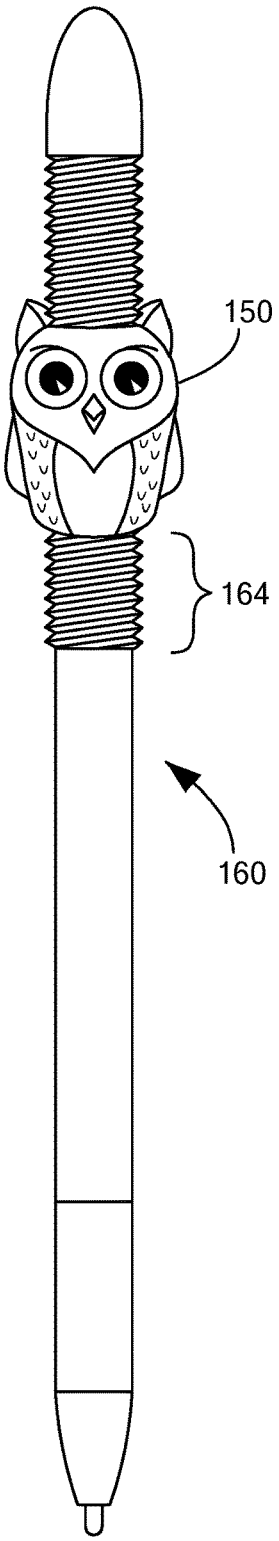
FIGS. 9A-9C show the alternate configurations engaging an ink delivery device.
Figure 9B:
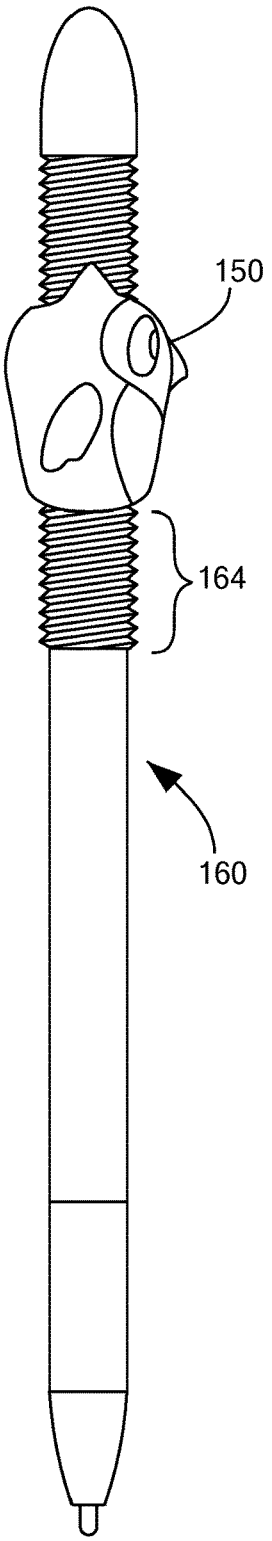
Figure 9C:
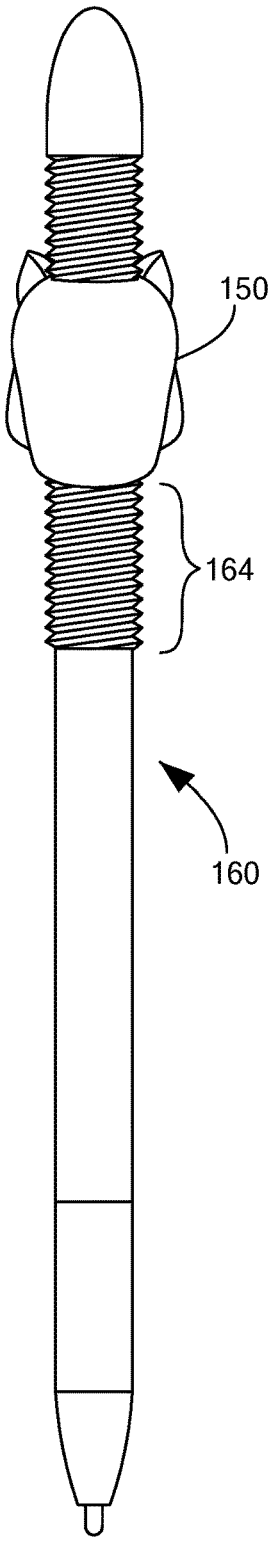

FIGS. 9A-9C show the alternate configurations engaging an ink delivery device, in which the elongated body 160 defines a pen having the helical portion 164 applied to the exterior surface. The focusing element 150 is that as depicted in FIGS. 8D1 and 8D2.

Figure 10A:
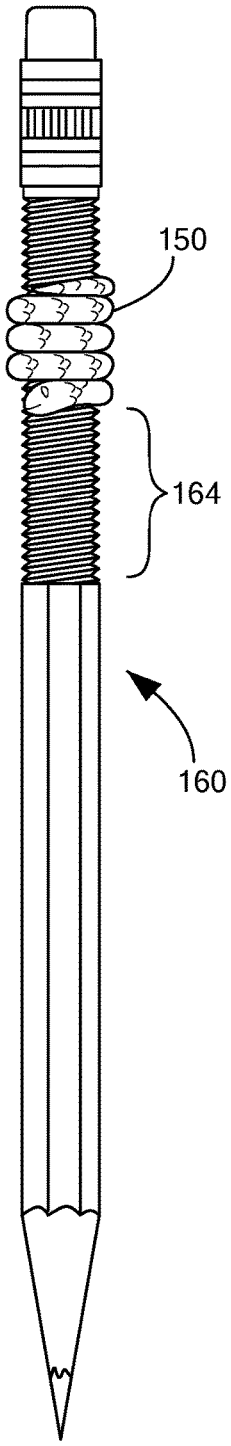
FIGS. 10A-10C show the alternate configurations engaging a friction based writing implement
Figure 10B:
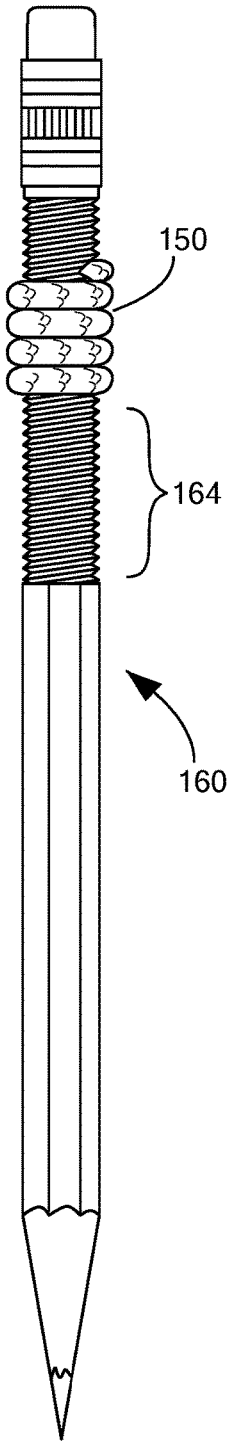
Figure 10C:
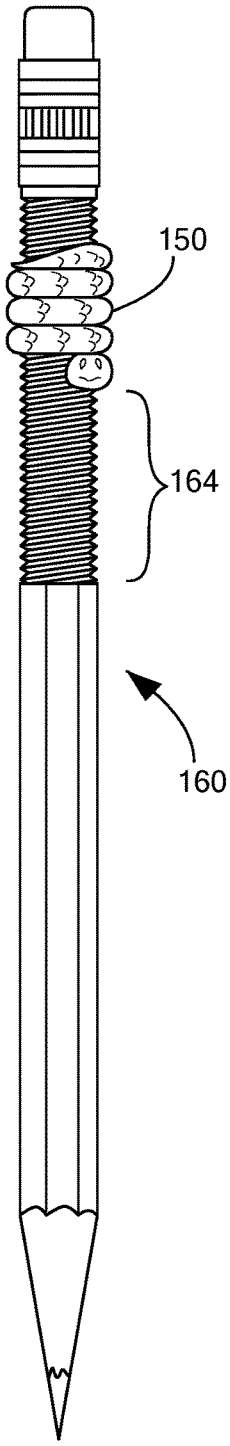

FIGS. 10A-10C show the alternate configurations engaging a friction based writing implement such as a pencil defining the elongated body 160 to which the helical portion 164 is applied, cut or formed. The focusing element 150 is as depicted in FIGS. 8B1 and 8B2.

While the system and methods defined herein have been particularly shown and described with references to embodiments thereof, it will be understood by those skilled in the art that various changes in form and details may be made therein without departing from the scope of the invention encompassed by the appended claims.

What is claimed is:

1. A therapeutic cognitive focus device, comprising:

an elongated body adapted for handheld operation;

a helical pattern in an exterior of at least a portion of the elongated body to define a helical portion; and a focusing element adapted for rotational communication with the elongated body, the focusing element adapted to be disposed along a length of the elongated body resulting from the rotation;

a threaded bore on the focusing element for engaging a corresponding helical groove on the elongated body, the focusing element threadedly engaged with the helical portion for rotational advancement along a length of the elongated body, the elongated body defined for a primary purpose unaffected by the focusing element, the elongated body defining an internal cavity for storing ink and having a distal end attached to a friction driven ink delivery mechanism, the threaded portion extending from a proximal end of the elongated body;

the elongated body being continuous between the helical portion and an unpatterned portion, further comprising a stop ring, the stop ring concentrically disposed around the elongated body and defining a transition between the helical portion and the unpatterned portion, the stop ring adapted for interference with rotation of the focusing element.

2. The device of claim 1 wherein the elongated body defines a writing implement, the helical pattern defined by a helical groove formed on a preexisting surface of the writing implement.

3. The device of claim 1 wherein the focusing element is substantially cubical, the threaded bore centered on opposed sides of the cubical shape.

4. The device of claim 3 further comprising moveable fixtures disposed on the focusing element and adapted for movement independent of the rotation of the focusing element.

5. The device of claim 4 wherein the moveable fixtures are based on a therapeutic motor exercise intended for satisfying a user regime.

6. The device of claim 5 wherein the moveable fixtures include at least one of a joystick, slider, roller or pushbutton attached to a face and adapted for independent movement.

7. The device of claim 5 wherein the moveable fixtures have an articulated communication from a fixed attachment to the focusing element.

8. The device of claim 1 wherein the elongated body has a utilitarian function resulting from the handheld operation.

9. The device of claim 1 wherein the stop ring has a concentric depth around the surface of the elongated body for abutting the focusing element.

* * * * *